US006468679B1

(12) United States Patent
Zhang et al.

(10) Patent No.: US 6,468,679 B1
(45) Date of Patent: Oct. 22, 2002

(54) METAL-BASED GRADIENT COMPOSITE MATERIAL HAVING GOOD LUBRICATION AND WEAR RESISTANCE PROPERTY, THE PRODUCTION AND THE USE OF THE SAME

(76) Inventors: Xinhui Zhang, No. 60 Zhuanta Hutong, Xisi, Beijing 100034 (CN); Yifei Zhang, No. 60 Zhuanta Hutong, Xisi, Beijing (CN)

( * ) Notice: Subject to any disclaimer, the term of this patent is extended or adjusted under 35 U.S.C. 154(b) by 0 days.

(21) Appl. No.: 09/530,081

(22) PCT Filed: Nov. 9, 1998

(86) PCT No.: PCT/CN98/00266

§ 371 (c)(1),
(2), (4) Date: Jun. 20, 2000

(87) PCT Pub. No.: WO99/24632

PCT Pub. Date: May 20, 1999

(30) Foreign Application Priority Data

Nov. 7, 1997 (CN) ..... 97120249 A

(51) Int. Cl.[7] ..... B32B 15/04; C23C 14/22

(52) U.S. Cl. ..... 428/697; 148/518; 204/192.12; 204/192.15; 204/192.16; 428/610; 428/698; 428/908.8; 428/941

(58) Field of Search ..... 428/697, 698, 428/908.8, 941, 610; 148/518; 204/192.12, 192.15, 192.16

(56) References Cited

U.S. PATENT DOCUMENTS 4,072,084 A 2/1978 Knight, Jr. et al. ..... 409/234

FOREIGN PATENT DOCUMENTS

| | | | | |
|---|---|---|---|---|
| CN | 85106828 A | | 3/1987 | |
| CN | 1119219 A | | 3/1996 | |
| CN | 1158909 A | | 9/1997 | |
| EP | 0 218 916 | | 4/1987 | |
| EP | 0218916 A1 | * | 4/1987 | ..... C23C/14/32 |
| JP | 51049138 A | | 4/1976 | |
| JP | 54128948 A | | 10/1979 | |
| JP | 55131172 A | | 10/1980 | |

OTHER PUBLICATIONS

Tribology; vol. 14, No. 3, P205 (1994); Jul. 1994.

Tribology; vol. 14, No. 4, P314 (1994); Oct. 1994.

* cited by examiner

*Primary Examiner*—Robert R. Koehler
(74) *Attorney, Agent, or Firm*—Burns, Doane, Swecker & Mathis, L.L.P.

(57) ABSTRACT

This invention is related to a metal-based gradient composite material having good lubrication and wear-resistance properties. The composite material comprises a metal (M) matrix and a gradient composite layer of metal sulfide (M[S]) and metal oxide,(M[O]) on the surface of said metal matrix. In the gradient composite layer,, the sum (Ds+Do) of the concentration of metal sulfide (Ds) and the concentration of metal oxide (Do) decreases gradually from the surface to the interior, and the concentration of metal ($D_M$) increases from the surface to the interior. The invention is also related to a process for producing the gradient composite material and the use of the same.

9 Claims, 5 Drawing Sheets

Gradient distribution of sulfur and oxygen in No.20 steel

Fig. 2 Gradient distribution of sulfur and oxygen in No.20 steel

Fig. 4 Gradient distribution of sulfur and oxygen in T4 copper
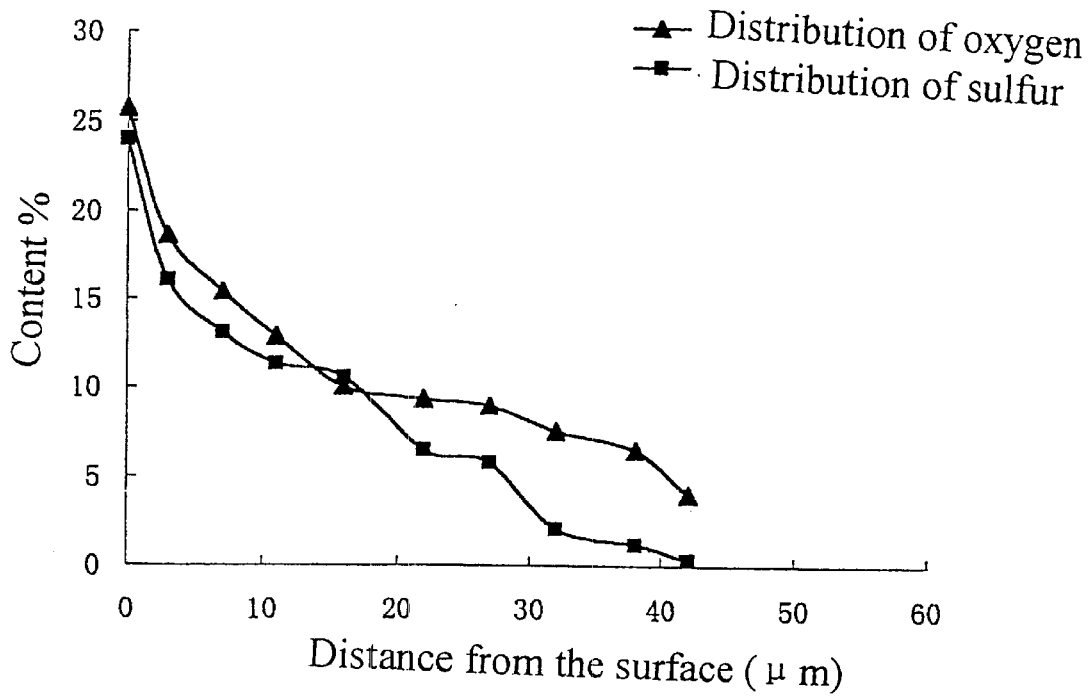

METAL-BASED GRADIENT COMPOSITE MATERIAL HAVING GOOD LUBRICATION AND WEAR RESISTANCE PROPERTY, THE PRODUCTION AND THE USE OF THE SAME

FIELD OF THE INVENTION

The invention relates to metal-based gradient composite material having good lubrication and wear-resistance properties, the invention also relates to a process for producing the gradient composite material as well as the use of the same.

BACKGROUND OF THE ART

According to the structure, material can be divided into two categories, i.e. integral materials and composite materials, so is materials having lubrication and wear resistance properties. Integral materials refer to material whose structure is homogenous throughout the whole material, such as metals, plastics and ceramics. For example, sliding bearings can be made from homogenous copper alloys or plastics. There are many kinds of composite materials, some of them are exemplified as follows:

(1) Composite material comprising a matrix on which a layer of metal or polymer is coated, e.g. steel on which a layer of copper or aluminum is coated can be used as sliding bearings in the engines, and babbit metal can be further plated on the outer copper or aluminum layer.

(2) Low friction composite material comprising graphite fiber and epoxy (see U.S. Pat. No. 4,072,084).

(3) A layer for lowering friction produced by means of deposition, sputtering, electroplating, ion-plating, ion implantation and the like, e.g. Li Wenmei et al. reported their research on wear of vapor deposited TiN and Ti(CN) at elevated temperature (TRIBOLOGY; Vol.14, No.3, P205), Luo Hong et al. studied the frictional characteristic of sputtered $MoS_2$ under grease lubrication ( TRIBOLOGY; Vol.14, No. 4, P314).

The common features of the three kinds of composite materials mentioned above lie in that they are mixtures or complex of different components, i.e. the distribution of the concentration of each component in the material is homogeneous or suddenly changed, and not gradually changed. This results in a poor comprehensive mechanical performance. When the surface layer of a composite material is selected from materials having low frictional coefficient and good wear-resistance properties, and the matrix of the composite material is selected from materials having good mechanical properties, some advantages may be obtained. But the interface between the surface and matrix is easily to peel off or rupture when the material is running under high load, because the bonding strength between the surface and matrix of the composite is low due to the mechanical bonding.

In 1987, Zhang Yifei (one of the inventors of the present application) has disclosed a process and equipment to form a sulfide case at the surface of metal parts (see CN85106828A or EP0218916). A layer of sulfide with a thickness of up to 120 $\mu$m can be produced by said process, and the bonding strength between sulfide layer and metal matrix is much improved compared with the prior art materials. However, a stable sulfide gradient layer is difficult to obtain due to its sensitivity to oxygen.

SUMMARY OF THE INVENTION

After intensive research work on the field, the inventors of the invention have accidentally discovered that if a complex of metal oxide and metal sulfide gradient layer is formed on the surface of a metal matrix, the existing technical defect as mentioned above can be overcome. Further effort lead to an easy production of the novel composite gradient layer of metal sulfide and metal oxide which has a good bonding strength with the metal matrix and exhibits excellent lubrication and wear-resistance properties.

According to the first aspect of the invention, the invention provides a metal-based gradient composite material having good lubrication and wear-resistance properties, characterized in that it comprising a metal (M) matrix, and a gradient composite layer of metal sulfide (M[S]) and metal oxide (M[O]) on the surface of said metal matrix, the sum (Ds+Do) of the concentration of metal sulfide (Ds) and the concentration of metal oxide (Do) in the gradient composite layer decreases gradually from the surface to the interior, while the concentration of the metal ($D_M$) in the gradient composite layer increases gradually from the surface to the interior.

According to a preferred embodiment of the invention, in the above-mentioned metal-based gradient composite material, both the concentration of metal sulfide (Ds) and the concentration of metal oxide (Do) in the gradient composite layer decrease gradually from the surface to the interior.

According to a preferred embodiment of the invention, in the above-mentioned metal-based gradient composite materials, said metal (M) is selected from iron (Fe), aluminum (Al), copper (Cu), nickel (Ni), molybdenum (Mo), titanium (Ti) and alloys thereof.

According to a preferred embodiment of the invention, in the above-mentioned metal-based gradient composite materials, said metal (M) matrix is selected from plating layer, coating layer, infiltration layer and deposition layer of iron (Fe), aluminum (Al), copper (Cu), nickel (Ni), molybdenum (Mo), titanium (Ti) and their alloys.

According to a preferred embodiment of the invention, in the above-mentioned metal-based gradient composite materials, the concentration of metal sulfide (Ds) and the concentration of metal oxide (Do) in said gradient composite layer satisfy the relationship of:

$$0\% < Do/Do+Ds < 30\% \text{ or}$$

$$0\% < Ds/Do+Ds < 30\%.$$

According to a preferred embodiment of the invention, in the above-mentioned metal-based gradient composite material, only metal sulfide M[S] and metal oxide M[O] are existing at the outermost surface of the gradient composite layer.

According to another aspect of the invention, the invention provides a process for producing the above-mentioned metal-based gradient composite material, comprising the steps of: an anode and cathode are provided in a vacuum chamber, a metal (M) matrix is laid on the cathode after the surface of-the metal matrix has been cleaned; then sulfur and/or oxygen atmosphere is created in the vacuum chamber, and 320V–1500V of D.C. voltage or D.C. pulse voltage is applied between the anode and cathode so that glow discharge occurs, and the temperature of the metal (M) matrix increases gradually and is maintained at a temperature of 130° C.–450° C. for a period of 3-15 hours.

The invention process can be carried out by means of the following embodiments:

1. Vapor of sulfur was introduced into the vacuum chamber firstly, the gradient compound of metal sulfide (M[S]) was produced on metal (M) matrix through the reaction of sulfur with metal (M) under high electric voltage; then the vapor of sulfur was drawn off and oxygen was introduced into the chamber, the gradient composite material comprising metal sulfide and metal oxide (M[S]+M[O]) can be produced on metal (M) matrix at appropriate temperature.

2. Oxygen was put into the vacuum chamber firstly, the gradient metal oxide (M[O]) was produced on the metal matrix by reacting oxygen with metal (M) under high voltage; then oxygen was removed and sulfur vapor was put into the vacuum chamber, the gradient composite material comprising of metal sulfide and metal oxide (M[S]+M[O]) can be produced on metal (M) matrix at a suitable temperature.
3. Vapor of sulfur was put into the vacuum chamber firstly, the gradient metal sulfide (M[S]) was produced on metal matrix by reacting sulfur with metal (M) under high voltage; then only part of sulfur vapor was expelled from the chamber and a certain proportion of oxygen was introduced into the chamber, the gradient composite material comprising metal sulfide and metal oxide (M[S]+M[O]) can be produced on metal (M) matrix.
4. Oxygen was put into vacuum chamber firstly, the gradient metal oxide (M[O]) was produced on metal matrix by reacting oxygen with metal (M) under high voltage, then a part of oxygen was removed and a certain proportion of sulfur vapor was introduced into the chamber, the gradient composite material comprising metal sulfide and metal oxide (M[S]+M[O]) can be produced on metal (M) matrix.
5. The introduction of oxygen and sulfur atmosphere can be carried out simultaneous, alternatively or discontinuously, and the D.C. voltage or the D.C. pulse voltage can be applied continuously or discontinuously. Different concentration of gradient composite material of metal sulfide and metal oxide (M[S]+M[O]) are acquired through the reaction of metal (M) matrix with different concentration of oxygen and sulfur in the vacuum chamber at different time.

According to the requirement as designed, the formation of M[S] and M[O] may be accelerated by means of discontinuous application of D.C. voltage or D.C. pulse voltage, or introducing metal halide at a certain phase of the above process. The metal-based gradient composite material having good lubrication wear-resistance properties can be produced alternatively by the method of spray coating, deposition, powder sintering etc. The gradient composite material having required properties with different ratio of oxide and sulfide on matrix can also be produced by corporately or alternatively operation of the above means.

The metal-based gradient composite material of the invention can be produced into various shapes. They can be used to manufacture various kinds of machinery parts, such as axles, crankaxles, piston rings, valves, pump bodies, cylinders, gears, worms and worm-gears, chains, drills, hobbings, milling cutters, rolling rollers, bearing parts, and connecting pieces. Compared with the prior art composite materials comprising sputtering coating, infiltration coating or plating coating, the metal-based gradient composite material of the invention possesses good stability, high bonding strength, excellent lubrication and wear-resistance properties and favorable fatigue strength.

BRIEF DESCRIPTION OF THE DRAWINGS

FIG. 4 illustrates the concentration distribution of sulfur and oxygen in the gradient composite material according to the following example 2.

BEST MODES TO CARRY THE INVENTION

The invention will be illustrated in detail by the following examples with reference to the accompanying drawings. But these illustrative examples are descriptive and should not be regarded as to restrict the invention in any sense.

EXAMPLE 1

Figure 1:
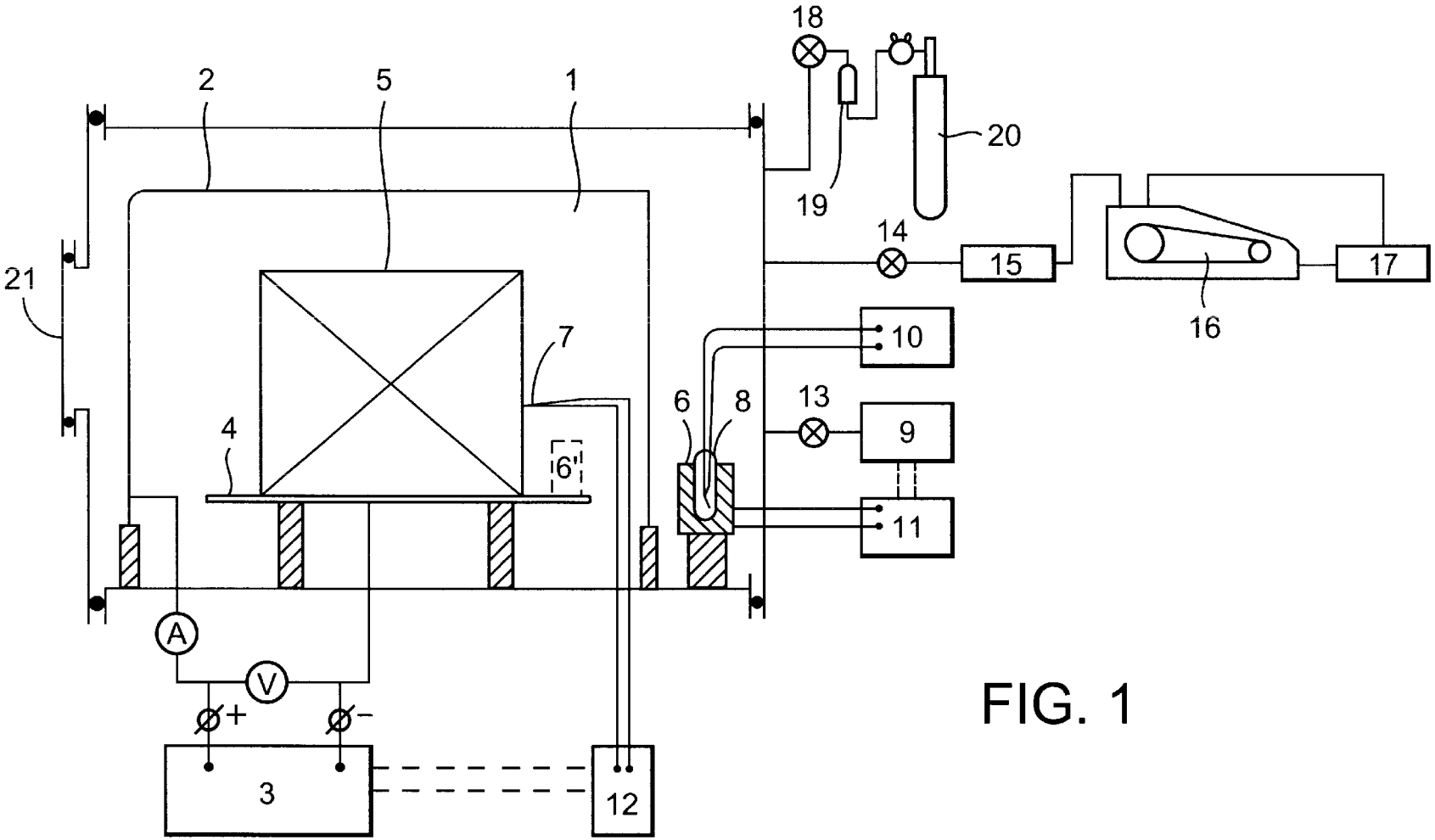
FIG. 1 schematically illustrates an apparatus that can be used to produce the gradient composite material of the invention.

FIG. 1 schematically illustrates an apparatus that can be used to produce the gradient composite material of the invention. In FIG. 1, (1) refers to the vacuum chamber; (2) refers to anode; (3) refers to direct current source; (4) refers to cathode; (5) refers to a metal matrix which is put on cathode plate; (6) refers to sulfur evaporator; (7) refers to thermal couple for measuring temperature of said metal matrix; (12) refers to thermometer; (16) refers to vacuum pump; (20) refers to gas-bomb; (19) refers to flowmeter. Sulfur vapor supplying system comprises various parts, such as (8), (9), (10), (11) and (13). The apparatus also includes some other parts, such as valves (14), (18), waste gas filter (17), observing window (21), and cold trap (15) to deposit reactants.

Metal matrix (5) was obtained by firstly carbonitriding No. 20 steel (0.02%C) under 850° C., then quenching and tempering the same. After surface cleaning, No. 20 steel (5) was placed on the cathode plate (4) in vacuum chamber (1), the temperature of metal (5) was measured by thermal couple (7). Starting vacuum pumps (16) and evacuating the chamber (1). The pressure of the chamber was measured by vacuum-meter (9). When the pressure reached 1.0 Pa, vacuum chamber was inflated with pure oxygen until its pressure reaching 133 Pa. Turned on the D.C. source (3), glow discharge was created between cathode and anode (2) under high D.C. pulse voltage controlled at 320–1500V As the temperature of No.20 steel increased, its chemical reaction with oxygen was taken place. The temperature of metal matrix was controlled at 150–250° C. for one hour by regulating the voltage and current. Then oxygen was evacuated and sulfur evaporator (6) was turned on; sulfur vapor (which was created in the same way as described in EP0218916) was introduced into the chamber, and the pressure of the chamber was controlled at 133 Pa by regulating vaporization of sulfur and the power of the pump. The temperature of metal matrix (5) was kept at 130–300° C. by regulation of voltage and current. Total duration of glow discharge was 2–20 hours. The gradient composite material was produced by keeping No. 20 steel for one-hour in oxygen atmosphere under 250° C., for two hours in sulfur vapor under 250° C. Its concentration distribution of sulfur and oxygen on profile was measured by PHI-610 Scanning Auger Microprobe, the result was shown in FIG. 2.

Figure 2:
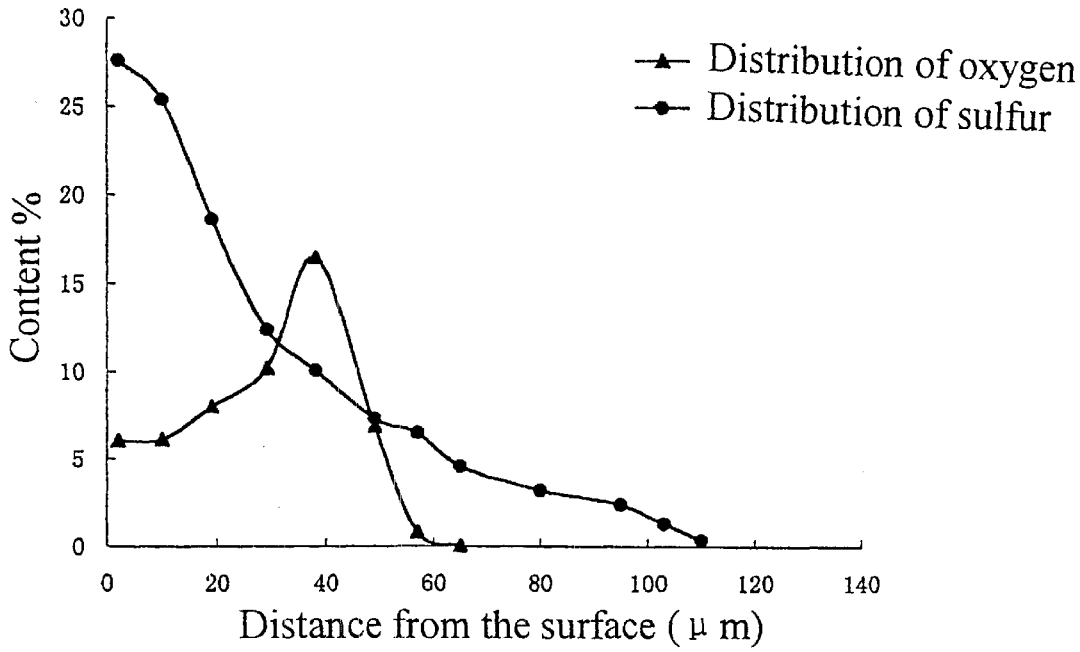
FIG. 2 illustrates the concentration distribution of sulfur and oxygen in the gradient composite material according to the following example 1.
Figure 3:
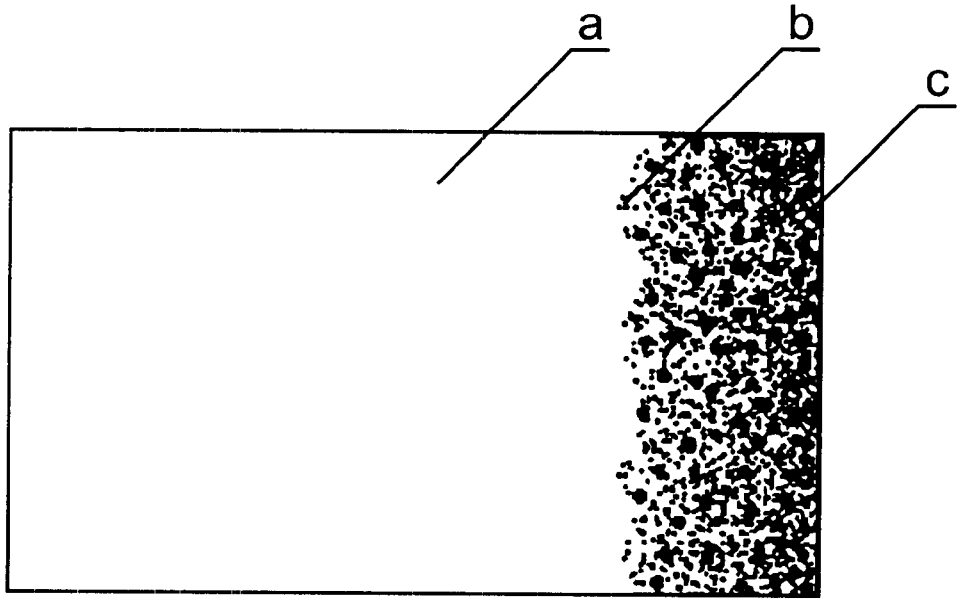
FIG. 3 schematically illustrates the distribution of metal, metal sulfide, and metal oxide in the gradient composite material according to example 1.

It can be seen from FIG. 2 that Ds+Do, which is the total concentration of metal sulfide (Ds) and metal oxide (Do), decrease gradually from the surface to the interior of the material, showing a gradient distribution in metal matrix. FIG. 3 schematically illustrates the gradient distribution of the composite material, wherein 'a' represents Fe, 'b' represents Fe[S] and 'c' represents Fe[O].

EXAMPLE 2

A complex gradient layer of oxide and sulfide was formed on T4 copper substrate by a method similarly to the one used in example 1. The technique process is as follows. The vacuum chamber was evacuated to 1.0 Pa, and oxygen is introduced until the pressure reaching 133 Pa. The temperature of T4 copper was increased to 200° C. in 3 hours by controlling voltage. Oxygen was evacuated and sulfur vapor was put into the chamber until its pressure reaching 133 Pa. The temperature of T4 copper was maintained at 220° C. for two hours by regulating the voltage, then sulfur vapor was evacuated and oxygen was put into the chamber until. the pressure reaching 133 Pa, the metal substrate was kept at 220° C. so that gradient composite material of T4 copper was obtained. Its concentration distribution of sulfur and oxygen on profile was measured by PHI-610 Scanning Auger Microprobe, the result was shown in FIG. 4.

Figure 5:
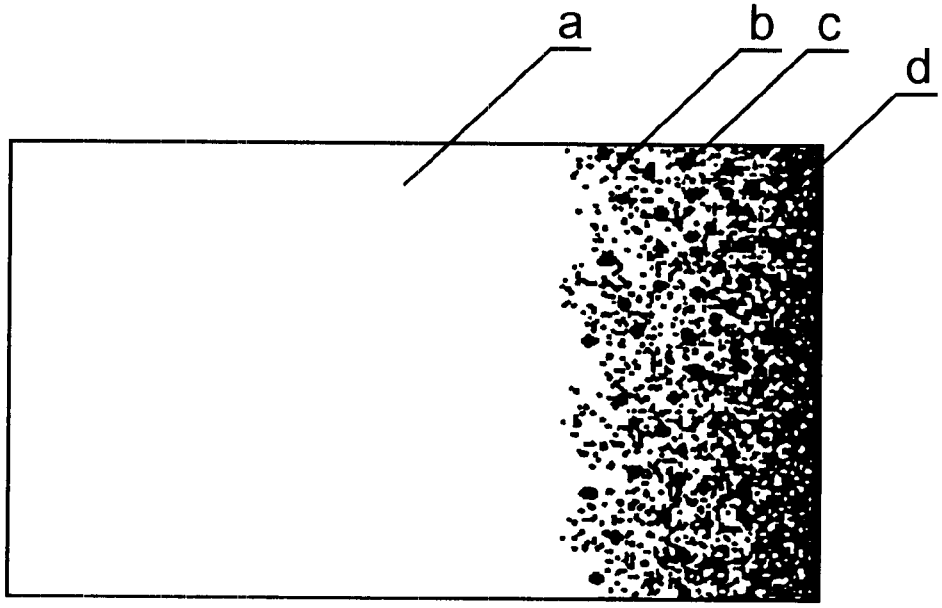
FIG. 5 schematically illustrates the distribution of metal, metal sulfide, and metal oxide in the gradient composite material according to example 2.

It can be seen from FIG. 4 that Ds+Do, which is the total concentration of metal sulfide (Ds) and metal oxide (Do), decrease gradually from the surface to the interior of the material. FIG. 5 schematically illustrates the gradient distribution of the composite material, wherein 'a' represents Cu, 'b' represents Cu[S] , 'c' represents Cu[O], 'd' represents the surface of the material which show that only Cu[S]+Cu[O] and no metal Cu is existing in the outermost surface.

The gradient composite copper is useful for sliding bearings in rolling mill.

EXAMPLE 3

A complex gradient layer of oxide and sulfide was formed on GCr15 steel by a method similarly to the one used in example 1, wherein said steel has already been infiltrated with molybdenum ion through glow discharge. The technique process is as follows. The vacuum chamber was evacuated to 1.0 Pa, and oxygen was introduced until the pressure reaching 133 Pa. The temperature of metal matrix was kept at 180° C. for 0.5 hour by controlling voltage. Oxygen was evacuated and sulfur vapor was put into the chamber until its pressure reaching 133 Pa. The temperature of metal matrix was maintained at 180° C. for two hours by regulating the voltage, and the gradient composite material comprising Fe[S],:Mo[S], Fe[O] and Mo[O] was produced on GCr15 steel.

EXAMPLE 4

A complex gradient layer of oxide and sulfide was formed on No.45 steel (0.045%C) by a method similarly to the one used in example 1, wherein said steel has already been infiltrated with tungsten ion through glow discharge. The technique process is as follows. The vacuum chamber was evacuated to 1.0 Pa, and oxygen was introduced until the pressure reaching 133 Pa. The temperature of metal matrix was kept at 250° C. for 0.5 hour by controlling voltage. Oxygen was evacuated and sulfur vapor was put into the chamber until its pressure reaching 133 Pa. The temperature of metal matrix was maintained at 250° C. for two hours by regulating the voltage, and the gradient composite material comprising Fe[S], W[S], Fe[O] and W[O] was produced on No.45 steel.

EXAMPLE 5

A complex gradient layer of oxide and sulfide was formed on ZL102 aluminum-silicon alloy by a method similarly to the one used in example 1, wherein said alloy has already been infiltrated with molybdenum ion through glow discharge. The technique process is as follows. The vacuum chamber was evacuated to 1.0 Pa, and oxygen was introduced until the pressure reaching 133 Pa. The temperature of metal matrix was increased to 180° C. in 0.5 hour by controlling voltage. Oxygen was evacuated and sulfur vapor was put into the chamber until its pressure reaching 133 Pa. The temperature of metal matrix was maintained at 180° C. for two hours by regulating the voltage, and the gradient composite material comprising Mo[S], A1[S], Mo[O] and A1[O] was produced on aluminum-silicon alloy.

EXAMPLE 6

A complex gradient layer of oxide and sulfide was formed on $TA_3$ titanium by a method similarly to the one used in example 1, wherein said titanium has already been infiltrated with molybdenum ion through glow discharge. The technique process is as follows. The vacuum chamber was evacuated to 1.0 Pa, and oxygen was introduced until the pressure reaching 133 Pa. The temperature of metal matrix was increased to 200° C. in 0.5 hour by controlling voltage. Oxygen was evacuated and sulfur vapor was put into the chamber until its pressure reaching 133 Pa. The temperature of metal matrix was maintained at 200° C. for two hours by regulating the voltage, and the gradient composite material comprising Ti[S], Mo[S], Ti[O] and Mo[O] was produced on $TA_3$ titanium.

EXAMPLE 7

A complex gradient layer of oxide and sulfide was formed on kennametal by a method similarly to the one used in example 1, wherein said kennametal has already been infiltrated with molybdenum ion through glow discharge. The technique process is as follows. The vacuum chamber was evacuated to 1.0 Pa, and oxygen was introduced until the pressure reaching 133 Pa. The temperature of metal matrix was increased to 200° C. in 0.5 hour by controlling voltage. Oxygen was evacuated and sulfur vapor was put into the chamber until its pressure reaching 133 Pa. The temperature of metal matrix was maintained at 250° C. for two hours by regulating the voltage, and the gradient composite material comprising Co[S], Mo[S], Co[O] and Mo[O] was produced on kennametal.

EXAMPLE 8

A complex gradient layer of oxide and sulfide was formed on high-speed-steel by a method similarly to the one used in example 1, wherein said steel has already been ion-deposited with TiN. The technique process is as follows. The vacuum chamber was evacuated to 1.0 Pa, and oxygen was introduced until the pressure reaching 133 Pa. The temperature of metal matrix was increased to 180° C. in 1 hour by controlling voltage. Oxygen was evacuated and sulfur vapor was put into the chamber until its pressure reaching 133 Pa. The temperature of metal matrix was maintained at 180° C. for two hours by regulating the voltage, and the gradient composite material comprising Fe[S], Ti[S], Fe[O] and Ti[O] was produced on the high-speed-steel.

EXAMPLE 9

A complex gradient layer of oxide and sulfide was formed on nickel by a method similarly to the one used in example 1. The technique process is as follows. The vacuum chamber was; evacuated to 1.0 Pa, and oxygen was introduced until the pressure reaching 133 Pa. The temperature of nickel matrix was kept at 180° C. for 0.5 hour by controlling voltage. Oxygen was evacuated and sulfur vapor was put into the chamber until its pressure reaching 133 Pa. The temperature of metal matrix was maintained at 250° C. for two hours by regulating the voltage, and the gradient composite material comprising Ni[S] and Ni[O] was produced on nickel matrix.

EXAMPLE 10

A complex gradient layer of oxide and sulfide was formed on copper by a method similarly to the one used in example 1, wherein said copper has already been coated with chromium by chemical deposition. The technique process is as follows. The vacuum chamber was evacuated to 1.0 Pa, and oxygen was introduced until the pressure reaching 133 Pa. The temperature of metal matrix was increased to 180° C. in 0.5 hour by controlling voltage. Oxygen was evacuated and sulfur vapor was put into the chamber until its pressure reaching 133 Pa. The temperature of metal matrix was maintained at 250° C. for two hours by regulating the voltage, and the gradient composite material comprising Cu[S], Cr[S], Cu[O] and Cr[O] was produced on chromium-coated copper.

Comparative Example 1

This example is used for illustrating; a comparison of the efficiency between the gradient composite material of the example 1 and carbonitriding No.20 steel when both applied as a material for steel rings in textile mull.

As the material of steel ring in textile mull, carbonitriding No.20 steel can only last for three to six months, and the gradient material of example 1 has more than 22 months lifetime under the same condition.

Comparative Example 2

This example is used for illustrating a comparison of wear-resistance property among three kinds of material. One kind of material is GCr15 steel. Another kind of material is Mo infiltration GCr15 steel comprising on its surface a sulfide case produced in accordance. with the prior art process as disclosed in CN85106828.6 or EP0218916. The third kind of material is the gradient composite material of example 3.

Figure 6:
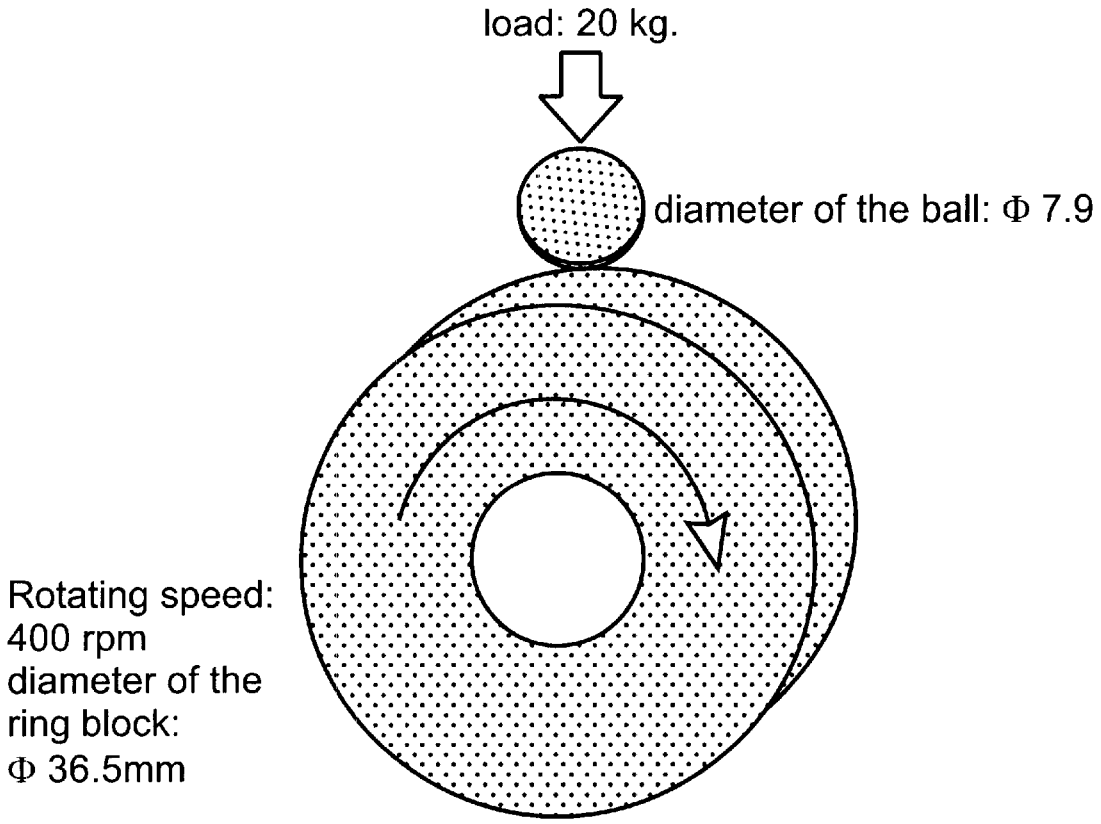
FIG. 6 schematically illustrates the dry friction experiment used to test the wear-resistance property of the material in comparative example 2.

Three kinds of materials respectively was made into balls with diameter of Φ7.9 mm. Dry friction test without lubricant agent was carried out on M2000 frictional wear machine. The test is schematically illustrated in FIG. 6. Test was carried out under the following conditions: rotation speed of the ring block (which is made of GCr15 steel) was 400 rpm, and the load on ball was 20kg. The test was stopped for each ball after ring block sliding for a distance of 183.47 m, and the grinding crack area of each ball was measured, the result was shown in Table 1. It can be seen from table 1 that the gradient composite material of the invention has excellent wear resistance property compared with prior art materials.

TABLE 1

A comparison of wear resistance property between the invention gradient composite material and prior art GCr15 steel under dry friction condition

| material tested | grinding crack area ($mm^2$) | load per unit area ($kg/cm^2$) |
|---|---|---|
| GCr15 steel | 12.63 | $1.584 \times 10^2$ |
| Mo infiltration GCr15 steel with sulfide case | 9.03 | $2.215 \times 10^2$ |
| the gradient composite material on GCr15 steel of example 3 | 3.94 | $5.076 \times 10^2$ |

What is claimed is:

1. A metal-based gradient composite material having good lubrication and wear-resistance properties, the composite material comprising a metal (M) matrix, and a gradient composite layer, the gradient composite layer including both metal sulfide (M) and metal oxide (M) on the surface of said metal matrix, the sum (Ds+Do) of the concentration of metal sulfide (Ds) and the concentration of metal oxide (Do) in the gradient composite layer decreases gradually from the surface to the interior, with the proviso that both the concentration of metal sulfide and the concentration of metal oxide are greater than zero, while the concentration of the metal ($D_m$) in the gradient composite layer increases gradually from the surface to the interior.

2. The metal-based gradient composite material according to claim 1, wherein both the concentration of metal sulfide (Ds) and the concentration of metal oxide (Do) in the gradient composite layer decrease gradually from the surface to the interior.

3. The metal-based gradient composite material according to claim 1, wherein said metal (M) is selected from iron (Fe), aluminum (Al), copper (Cu), nickel (Ni), molybdenum (Mo), titanium (Ti) and alloys thereof.

4. The metal-based gradient composite material according to claim 3, wherein said metal (M) matrix is selected from plating layer, coating layer, infiltration layer and deposition layer of iron (Fe), aluminum (Al), copper (Cu), nickel (Ni), molybdenum (Mo), titanium (Ti) and their alloys.

5. The metal-based gradient composite material according to claim 1, wherein the concentration of metal sulfide (Ds) and the concentration of metal oxide (Do) in said gradient composite layer satisfy the relationship of:

$$0\% < Do/Do+Ds < 30\% \text{ or}$$

$$0\% < Ds/Do+Ds < 30\%.$$

6. The metal-based gradient composite material according to claim 1, wherein only metal sulfide M[S] and metal oxide M[O] are existing at the outermost surface of the gradient composite layer.

7. The metal-based gradient composite material according to claim 6, wherein the concentration of metal sulfide (Ds) and the concentration of metal oxide (Do) in said gradient composite layer satisfy the relationship of:

$$0\% < Do/Do+Ds < 30\% \text{ or } 0\% < Ds/Do+Ds < 30\%.$$

8. A process for producing the metal-based gradient composite material as claimed in claim 1, comprising the steps of:

a. providing an anode and a cathode within a vacuum chamber;

b. loading a metal matrix on the cathode after cleaning the surface of the metal matrix;

c. creating a sulfur or oxygen atmosphere in the vacuum chamber by introducing sulfur vapor or oxygen into the chamber;

d. applying DC voltage or DC pulse voltage of 320–1500 V to the anode and the cathode so as to create glow discharge between the anode and the cathode and increase the temperature of the metal matrix gradually;

e. controlling the temperature of the metal matrix between 130 C.–450° C. for a period of 0.5–15 hours by adjusting the voltage applied to the anode and cathode;

f. repeating steps c) to e) for one or more times, but changing the gas atmosphere in the vacuum chamber from sulfur atmosphere to oxygen atmosphere or from oxygen atmosphere to sulfur atmosphere at each time, so as to form the desired metal-based gradient composite material.

9. A process for producing a mechanical part or equipment, comprising the step of processing the metal-based gradient composite material as claimed in claim 1 into a desired shape of the mechanical part or equipment.

* * * * *